US006353972B2

(12) United States Patent
Berner

(10) Patent No.: US 6,353,972 B2
(45) Date of Patent: Mar. 12, 2002

(54) APPARATUS FOR CLEANING TRAVELING FLAT BARS OF A CARDING MACHINE

(75) Inventor: Erwin Berner, Mönchengladbach (DE)

(73) Assignee: Trützschler GmbH & Co. KG, Münchengladbach (DE)

( * ) Notice: Subject to any disclaimer, the term of this patent is extended or adjusted under 35 U.S.C. 154(b) by 0 days.

(21) Appl. No.: 09/843,869

(22) Filed: Apr. 30, 2001

Related U.S. Application Data

(63) Continuation of application No. 09/722,019, filed on Nov. 27, 2000.

(30) Foreign Application Priority Data

Nov. 27, 1999 (DE) ..... 199 57 237

(51) Int. Cl.[7] ..... D01G 15/02

(52) U.S. Cl. ..... 19/102; 19/107; 19/109; 19/111

(58) Field of Search ..... 19/98, 102, 104, 19/107, 109, 110, 111, 113, 114

(56) References Cited

U.S. PATENT DOCUMENTS

| | | | | | |
|---|---|---|---|---|---|
| 1,614,103 | A | * | 1/1927 | Clark | 19/107 |
| 1,616,896 | A | * | 2/1927 | Greenhill | 19/107 |
| 1,622,246 | A | * | 3/1927 | Clark | 19/107 |
| 1,633,542 | A | * | 6/1927 | Clark | 19/107 |
| 1,635,834 | A | * | 7/1927 | Goldsmith | 19/107 |
| 1,905,265 | A | * | 4/1933 | Clark | 19/107 |
| 4,368,561 | A | | 1/1983 | Trutzschler | |
| 4,996,746 | A | * | 3/1991 | Verzilli et al. | 19/111 |
| 5,259,092 | A | * | 11/1993 | Lambe et al. | 19/109 |
| 6,052,871 | A | * | 4/2000 | Patelli et al. | 19/109 |

FOREIGN PATENT DOCUMENTS

| | | |
|---|---|---|
| DE | 1 955 775 | 5/1971 |
| DE | 36 05 631 | 8/1987 |
| DE | 38 34 452 | 4/1990 |
| EP | 0 249 771 | 12/1987 |

* cited by examiner

*Primary Examiner*—John J. Calvert
*Assistant Examiner*—Gary L. Welch
(74) *Attorney, Agent, or Firm*—Venable; Gabor J. Kelemen

(57) ABSTRACT

A carding machine includes a main carding cylinder and a traveling flats assembly including flat bars circulating in a path and cooperating with the main carding cylinder. The carding machine further includes an apparatus for cleaning the flat bars. The apparatus includes a stationary track extending adjacent and transversely to the travel path of the flat bars; a carriage mounted on the track for back-and-forth travel thereon between opposite track ends; a blow nozzle mounted on the carriage and oriented at an oblique angle to the flat bar clothing of a flat bar situated in an effective range of the blow nozzle; and an arrangement for supplying pressurized air to the blow nozzle for causing it to eject an air jet for impinging on the flat bar clothing and for propelling the carriage along the track.

8 Claims, 4 Drawing Sheets

APPARATUS FOR CLEANING TRAVELING FLAT BARS OF A CARDING MACHINE

CROSS REFERENCE TO RELATED APPLICATION

This application is a continuation of pending U.S. application Ser. No. 09/722,019 filed Nov. 27, 2000.

This application claims the priority of German Application No. 199 57 237.2 filed Nov. 27, 1999, which is incorporated herein by reference.

BACKGROUND OF THE INVENTION

This invention realates to an apparatus for cleaning slowly circulating flat bars in a carding machine, particularly for removing dust, short fibers and the like from the clothings of the flat bars.

In a known apparatus, as disclosed in German Offenlegungsschrift (application published without examination) 29 26 261, to which corresponds U.S. Pat. No. 4,368,561, a slowly rotating flat bar brush is provided which cooperates with the clothing of the flat bars. In particular, the flat bar brush loosens the flat bar strip from the flat bars.

Dust and short fibers settle over time deeply and firmly in the flat bar clothing. In practice, the depth of penetration of the flat bar brush may be adjusted. For better cleaning, deeply seated dust and short fiber parts are removed by a hand brush. Disadvantageously, this procedure is circumstantial and time consuming and involves lengthy down periods. Also, the removal of certain impurities, such as honeydew is complicated.

SUMMARY OF THE INVENTION

It is an object of the invention to provide an improved apparatus of the above-outlined type from which the discussed disadvantages are eliminated and which permits in a simple manner an improved cleaning of the clothings of the circulating flat bars.

This object and others to become apparent as the specification progresses, are accomplished by the invention, according to which, briefly stated, the carding machine includes a main carding cylinder having a cylinder clothing; and a traveling flats assembly including flat bars circulating in a predetermined path and cooperating with the main carding cylinder. The flat bars have a length oriented perpendicularly to the travel path and a flat bar clothing for cooperating with the cylinder clothing. The carding machine further includes an apparatus for cleaning the flat bars. The apparatus includes a stationary track having first and second track ends and extending adjacent and transversely to the travel path of the flat bars; a carriage mounted on the track for back-and-forth travel thereon between the first and second track ends; a blow nozzle mounted on the carriage and oriented at an oblique angle to the flat bar clothing of a flat bar situated in an effective range of the blow nozzle; and an arrangement for supplying pressurized air to the blow nozzle for causing it to eject an air jet for impinging on the flat bar clothing and for propelling the carriage along the track.

The invention provides for an improved cleaning of the clothings of circulating flat bars. The compressed air stream directed obliquely to the clothings, dislodges dust, short fibers and the like and effectively blows the impurities away. Advantageously, the removed impurities are carried away by the trash removal vacuum system of the carding machine. The obliquely oriented pressurized air jet at the same time propels the carriage along the length of the traveling flats. The air jet blows the impurities in a direction opposite to the travel of the carriage, avoiding soiling of the latter.

DESCRIPTION OF THE PREFERRED EMBODIMENT

Figure 1:
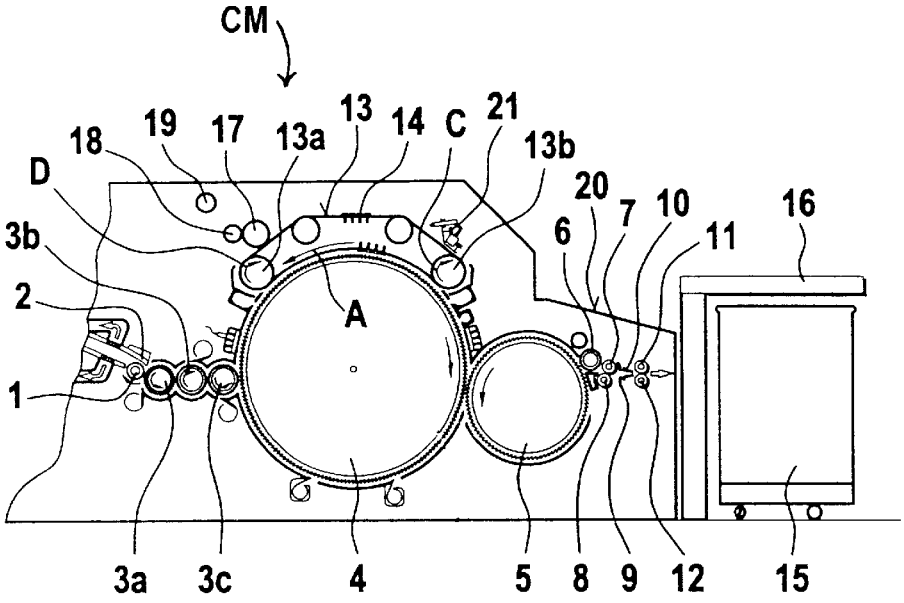
FIG. 1 is a schematic side elevational view of a carding machine incorporating the invention.

FIG. 1 illustrates a carding machine CM which may be, for example, a high performance DK 903 model manufactured by Trutzschler GmbH & Co. KG, Monchengladbach, Germany. The carding machine CM has a feed roll 1, a feed table 2 cooperating with the feed roll 1, licker-ins 3*a,* 3*b,* 3*c,* a main carding cylinder 4, a doffer 5, a stripping roll 6, crushing rolls 7, 8, a web guiding element 9, a sliver trumpet 10, calender rolls 11, 12 and a traveling flats assembly 13 having slowly circulating flat bars 14 at a speed of between 0.05 and 0.4 m/min. The flat bars 14 are at opposite ends thereof drawn by an endless belt trained about end sprockets 13*a,* 13*b.* The flat bars 14 are pulled by the belt in the direction A over non-illustrated slide bends and are deflected by the end sprocket 13*a* in the direction D, then are moved in the opposite direction B on the opposite side as shown in FIG. 2 and then again deflected by the sprocket 13*b* in the direction C. The arrows C and D at the same time indicate the direction of rotation of the end sprockets 13*b* and 13*a.* The direction of rotation of the rolls of the carding machine is indicated by the curved arrows drawn into the respective rolls. At the outlet of the carding machine a coiler mechanism 16 is disposed which deposits the outputted sliver into a coiler can 15. On the return side the flat bars 14 cooperate with a slowly rotating flat bar brush 17 which is cleaned by a rapidly rotating cleaning roll 18. A suction device 19 draws waste, dust, short fibers and the like from the inner space underneath the cover 20 of the carding machine. The apparatus according to the invention is designated at 21.

Figure 2:
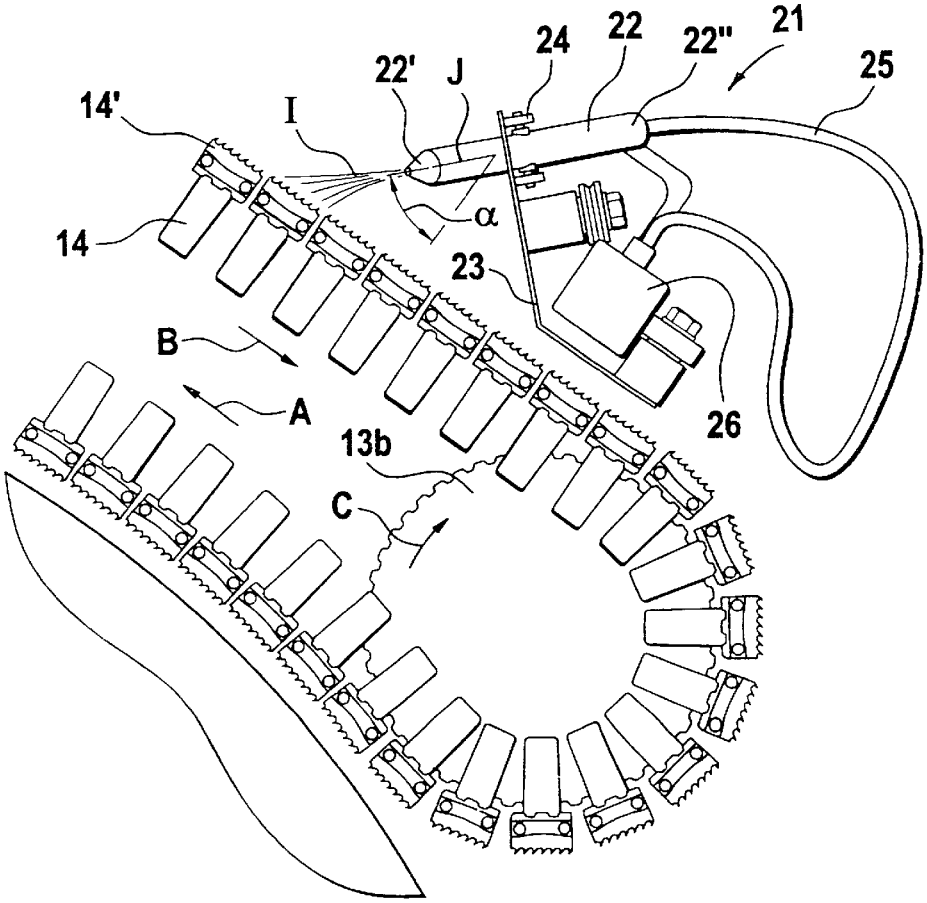
FIG. 2 is a side elevational view of the apparatus according to the invention, cleaning the flat bars as they approach an end sprocket of the traveling flats assembly.
Figure 3:
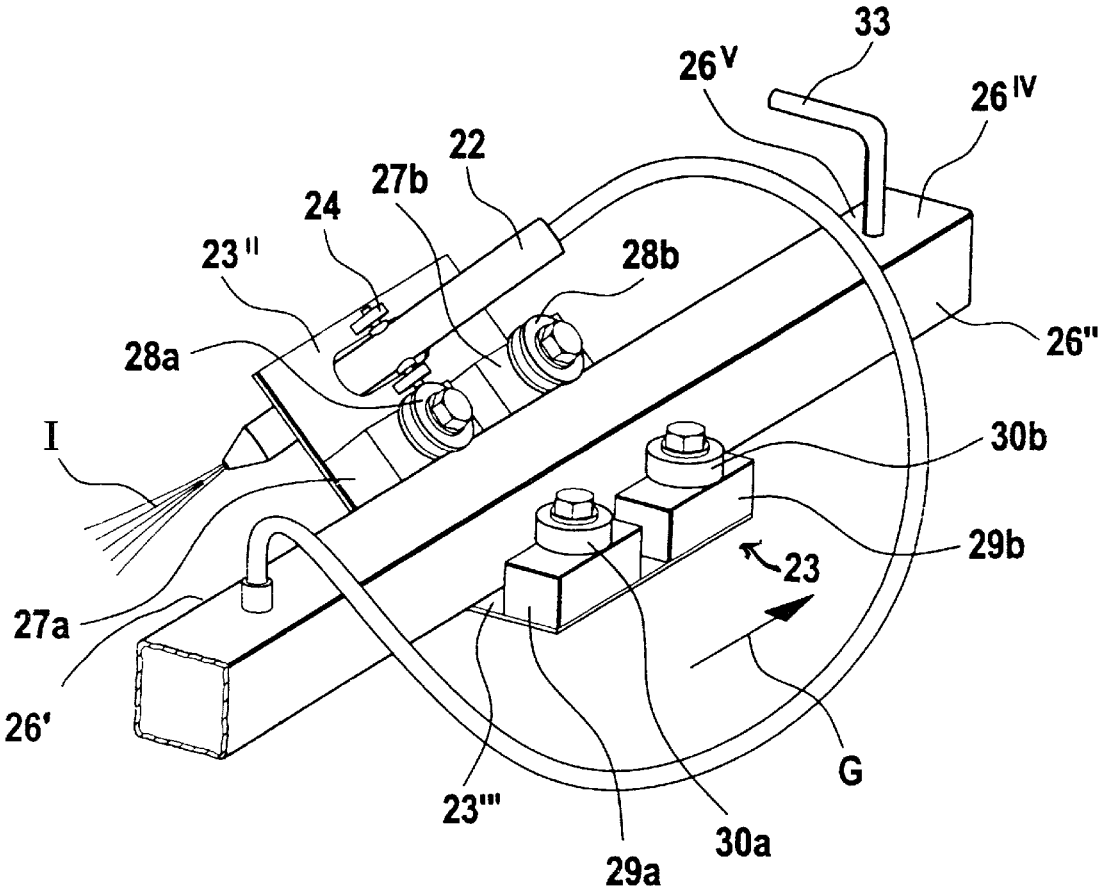
FIG. 3 is a perspective view of the apparatus according to the invention.

Turning to FIG. 2, a blow nozzle 22 is mounted on an angled holding element 23' of a carriage 23 at an angle a relative to a line perpendicular to the travel path of the flat bars. Preferably, $\alpha$ is approximately between −30° and +30° with respect to such perpendicular line. Thus, the conical blow nozzle outlet 22' emits an air jet I directed at an oblique angle to the clothings 14' of the flat bars 14 traveling rearward in the direction B (idling run). As shown in FIGS. 2 and 3, the holding element 23' is composed of two legs 23" and 23'" oriented at an obtuse angle to one another. The leg 23' carries a rotary support 24 about which the nozzle 22 may pivot in opposite directions (arrows F and H in FIGS. 4*b* and 4*d,* respectively) in a plane in which the longitudinal nozzle axis J lies. At the opposite end from the nozzle outlet 22' the nozzle 22 has an inlet opening 22" for admitting compressed air. The inlet opening 22" is coupled by means of a pressure hose 25 to a stationary pressurized air duct 26 which extends parallel to the length of the flat bars 14 of the traveling flats assembly 13 (and is thus oriented parallel to the machine width) and perpendicularly to the traveling direction A, B of the flat bars. The duct 26 may have a quadratic, rectangular or circular cross section.

Figure 4A:
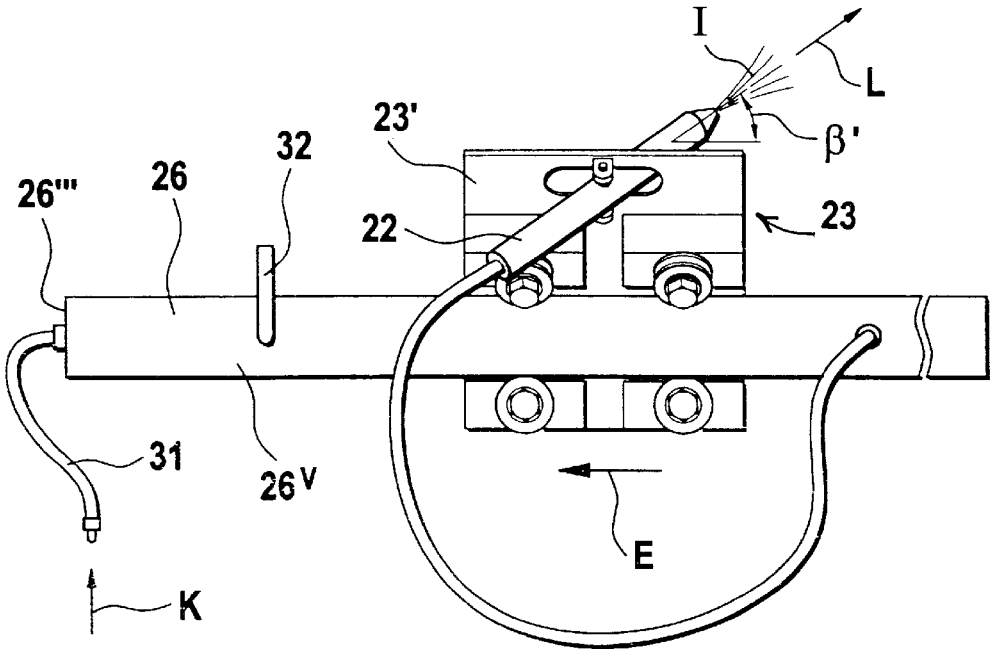
FIG. 4*a* is a top plan view of the apparatus according to the invention, depicted during its travel toward a first end of the pressurized air duct.

As shown in FIG. 3, the leg 23" supports two holding blocks 27*a,* 27*b* which, in turn, carry two wheels 28*a* and 28*b* which may be, for example, roller bearings rotatable about an axis. The concave running faces of the wheels 28*a,* 28*b* engage and move on an outer edge 26' of the duct 26. The leg 23'" supports two further holding blocks 29*a,* 29*b* which, in turn, carry two wheels 30*a* and 30*b* which also may be roller bearings. The running faces of the wheels 30*a,* 30*b* are cylindrical and run on an outer surface 26" of the duct 26. As shown in FIGS. 3 and 4*a,* on the upper duct face $26^{V}$, in the region of the end faces $26^{III}$ and $26^{IV}$, two inwardly bent respective abutment bars 32 and 33 are arranged.

As shown in FIG. 4*a,* the duct 26 is coupled to a pressure conduit 31 through which pressurized air K is Iintroduced into the duct 26 from a non-illustrated source of pressurized air. The carriage 23 travels in the direction E toward the end face 26'" of the channel 26. The nozzle 22 is, as viewed from the top, oriented at an angle β' to the longitudinal axis of-the clothings 14'. Such a longitudinal clothing axis extends parallel to the travel direction E and perpendicularly to the drawing plane of FIG. 2. Stated differently, the angle β' is formed between the nozzle axis J and a line parallel to the traveling track of the carriage 23. By means of the powerful air jet I directed obliquely to the clothing 14' impurities adhering or embedded therein are effectively dislodged. At the same time, the reaction force of the air jet propels the carriage 23 along the duct 26 in the direction E opposite the blowing direction L of the air jet I.

Figure 4B:
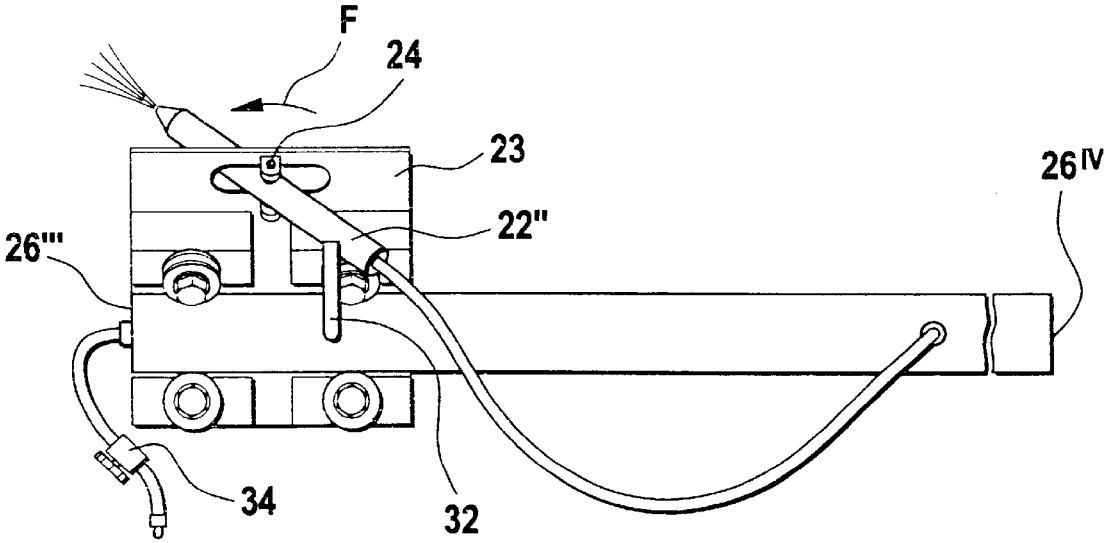
FIG. 4*b* is a top plan view of the apparatus according to the invention, depicted as the air nozzle reverses its orientation at the first end of the pressurized air duct.

As depicted in FIG. 4*b,* the carriage 23 has arrived in the region of the end face 26'". The nozzle 22 collides, in the vicinity of the inlet 22", with the abutment 32 and is pressed thereagainst such that the nozzle 22 is swung automatically in the direction F about the pivotal support 24 and assumes its position illustrated in FIG. 4*b*. FIG. 4*b* also shows a valve 34 by means of which the pressurized air supply K in the channel 26 is set and thus the outlet force of the air jet I may be controlled to regulate the cleaning effect of the air jet and the traveling speed of the carriage 23.

Figure 4C:
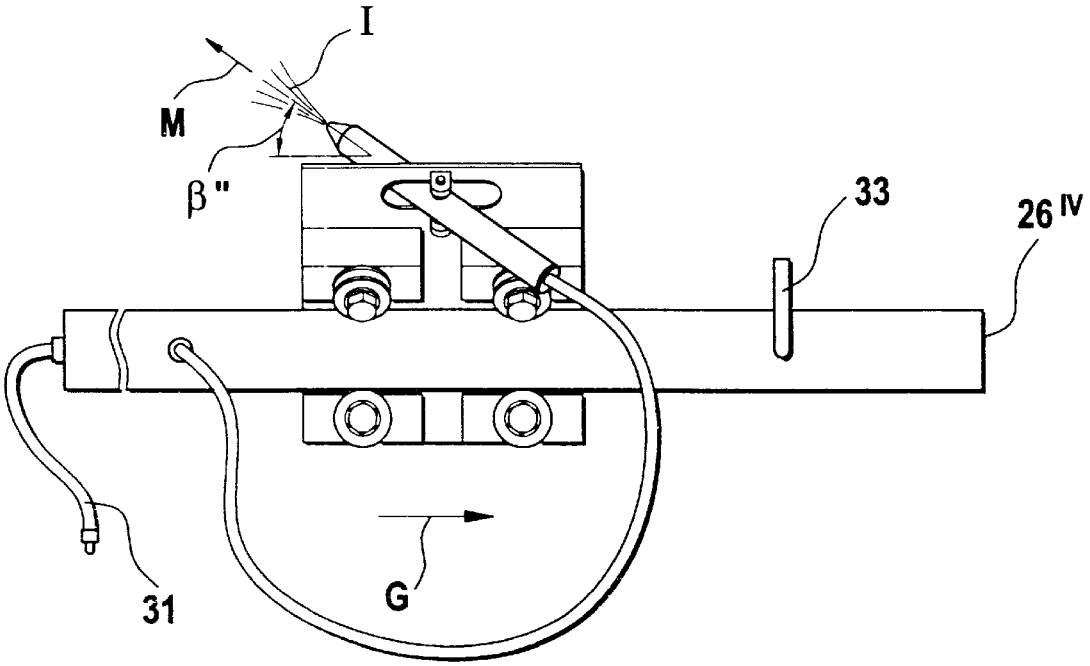
FIG. 4*c* is a top plan view of the apparatus according to the invention, depicted during its travel toward a second end of the pressurized air duct.

Thereafter, as shown in FIG. 4*c,* the carriage 23 and the nozzle 22 travel in the direction G as propelled by the air jet I, having a blowing direction M. As viewed from the top, the nozzle 22 is oriented toward the flat bar clothing 14' of the flat bar located in the effective range of the nozzle at an angle β" to the longitudinal clothing axis (FIG. 2). The angle β' or β" is preferably approximately between 20° and 60°.

Figure 4D:
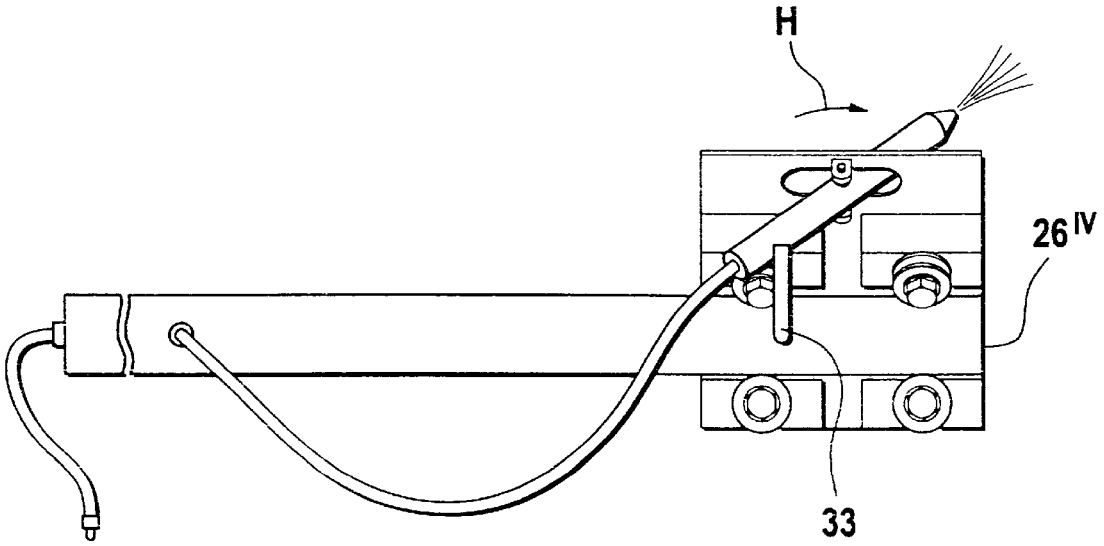
FIG. 4*d* is a top plan view of the construction shown in FIG. 4*a* depicted as the air nozzle reverses its orientation at the second end of the pressurized air duct.

As shown in FIG. 4*d,* in the region of the end face $26^{IV}$ the stationary abutment 33 presses against the inlet zone 22", thus causing the nozzle 22 to swing about the pivotal support 24 in the direction of the arrow H to assume again its travel position depicted in FIG. 4*a*.

The apparatus 21 according to the invention which is very simple to operate and is maintenance free, may be used by itself or in addition to the flat bar brush 17. In such a case the apparatus 21 acts as a relief for the flat brush 17, since the latter, sharing its cleaning work with the apparatus 21, does not have to be set to penetrate the clothing 14' as deeply as in the absence of the cleaning apparatus 21.

It will be understood that the above description of the present invention is susceptible to various modifications, changes and adaptations, and the same are intended to be comprehended within the meaning and range of equivalents of the appended claims.

What is claimed is:

1. A carding machine comprising (a) a main carding cylinder having a cylinder clothing;

(b) a traveling flats assembly including flat bars circulating in a predetermined path and cooperating with said main carding cylinder; said flat bars having a length oriented perpendicularly to said path and a flat bar clothing for cooperating with the cylinder clothing; and (c) an apparatus for cleaning the flat bars; said apparatus including (1) a stationary track having first and second track ends; said track extending adjacent and transversely to said path;

(2) a carriage mounted on said track for back-and-forth travel thereon between said first and second track ends;

(3) a blow nozzle mounted on said carriage and oriented at an oblique angle to the flat bar clothing of a flat bar situated in an effective range of said blow nozzle; said blow nozzle having a blow nozzle outlet; said blow nozzle having a first pivotal position in which said blow nozzle outlet is oriented in a direction pointing away from said first track end and a second pivotal position in which said blow nozzle outlet is oriented in a direction pointing away from said second track end;

(4) a support on said carriage for pivotally holding said blow nozzle;

(5) switching means for switching said blow nozzle from said first pivotal position into said second pivotal position upon arrival of said carriage at said first track end and for switching said blow nozzle from said second pivotal position into said first pivotal position upon arrival of said carriage at said second track end; and (6) means for supplying pressurized air to said blow nozzle for causing said blow nozzle to eject an air jet from said blow nozzle outlet for impinging on said flat bar clothing of the flat bar situated in said effective range and for propelling said carriage along said track.

2. The carding machine as defined in claim 1, wherein said switching means comprises first and second abutments mounted on said track in a region of said first and second track ends, respectively, for colliding with said blow nozzle and causing pivotal motions thereof from one of said first and second positions into the other of said first and second positions.

3. The carding machine as defined in claim 1, wherein said track extends parallel to said length.

4. The carding machine as defined in claim 1, further comprising a vacuum removal device for carrying away waste from a working space of said carding cylinder and said traveling flats assembly; said vacuum device being arranged for drawing away waste dislodged from said flat bars by the air jet emitted by said blow nozzle.

5. A carding machine comprising (a) a main carding cylinder having a cylinder clothing;

(b) a traveling flats assembly including flat bars circulating in a predetermined path and cooperating with said main carding cylinder; said flat bars having a length oriented perpendicularly to said path and a flat bar clothing for cooperating with the cylinder clothing; and (c) an apparatus for cleaning the flat bars; said apparatus including (1) a stationary track having first and second track ends; said track extending adjacent and transversely to said path;

(2) a carriage mounted on said track for back-and-forth travel thereon between said first and second track ends:

(3) a blow nozzle mounted on said carriage and oriented at an oblique angle to the flat bar clothing of a flat bar situated in an effective range of said blow nozzle; said blow nozzle having a nozzle axis defining a travel direction of an air jet emitted by the nozzle opening; said oblique angle being composed of a first angle formed between said nozzle axis and a direction perpendicular to said path and a second angle formed between said nozzle axis and a direction parallel to said track; said first angle being approximately between −30° and +30°; and (4) means for supplying pressurized air to said blow nozzle for causing said blow nozzle to eject the air jet from a blow nozzle outlet for impinging on said flat bar clothing of the flat bar situated in said effective range and for propelling said carriage along said track.

6. A carding machine comprising (a) a main carding cylinder having a cylinder clothing;

(b) a traveling flats assembly including flat bars circulating in a predetermined path and cooperating with said main carding cylinder; said flat bars having a length oriented perpendicularly to said path and a flat bar clothing for cooperating with the cylinder clothing; and (c) an apparatus for cleaning the flat bars; said apparatus including (1) a stationary track having first and second track ends; said track extending adjacent and transversely to said path;

(2) a carriage mounted on said track for back-and-forth travel thereon between said first and second track ends;

(3) a blow nozzle mounted on said carriage and oriented at an oblique angle to the flat bar clothing of a flat bar situated in an effective range of said blow nozzle; said blow nozzle having a nozzle axis defining a travel direction of an air jet emitted by the nozzle opening; said oblique angle being composed of a first angle formed between said nozzle axis and a direction perpendicular to said path and a second angle formed between said nozzle axis and a direction parallel to said track; said second angle being approximately between 20° and 60°; and (4) means for supplying pressurized air to said blow nozzle for causing said blow nozzle to eject the air jet from a blow nozzle outlet for impinging on said flat bar clothing of the flat bar situated in said effective range and for propelling said carriage along said track.

7. A carding machine comprising (a) a main carding cylinder having a cylinder clothing;

(b) a traveling flats assembly including flat bars circulating in a predetermined path and cooperating with said main carding cylinder; said flat bars having a length oriented perpendicularly to said path and a flat bar clothing for cooperating with the cylinder clothing; and (c) an apparatus for cleaning the flat bars; said apparatus including (1) a stationary track having first and second track ends; said track extending adjacent and transversely to said path;

(2) a carriage mounted on said track for back-and-forth travel thereon between said first and second track ends;

(3) a blow nozzle mounted on said carriage and oriented at an oblique angle to the flat bar clothing of a flat bar situated in an effective range of said blow nozzle;

(4) means for supplying pressurized air to said blow nozzle for causing said blow nozzle to eject an air jet from a blow nozzle outlet for impinging on said flat bar clothing of the flat bar situated in said effective range and for propelling said carriage along said track; said means for supplying pressurized air comprising (i) a duct containing pressurized air; said duct having a wall constituting said track; and (ii) a flexible pressure hose coupling said duct with said blow nozzle.

8. A carding machine comprising (a) a main carding cylinder having a cylinder clothing;

(b) a traveling flats assembly including flat bars circulating in a predetermined path and cooperating with said main carding cylinder; said flat bars having a length oriented perpendicularly to said path and a flat bar clothing for cooperating with the cylinder clothing; and (c) an apparatus for cleaning the flat bars; said apparatus including (1) a stationary track having first and second track ends; said track extending adjacent and transversely to said path;

(2) a carriage mounted on said track for back-and-forth travel thereon between said first and second track ends;

(3) a blow nozzle mounted on said carriage and oriented at an oblique angle to the flat bar clothing of a flat bar situated in an effective range of said blow nozzle; and (4) means for supplying pressurized air to said blow nozzle for causing said blow nozzle to eject an air jet from a blow nozzle outlet for impinging on said flat bar clothing of the flat bar situated in said effective range and for propelling said carriage along said track; said means for supplying pressurized air comprising valve means for regulating a force of said air jet.

* * * * *